US007938565B2

(12) United States Patent
Richard

(10) Patent No.: US 7,938,565 B2
(45) Date of Patent: May 10, 2011

(54) OUTDOOR LIGHT APPARATUS AND ASSEMBLY

(76) Inventor: James G. Richard, East Otis, MA (US)

( * ) Notice: Subject to any disclaimer, the term of this patent is extended or adjusted under 35 U.S.C. 154(b) by 144 days.

(21) Appl. No.: 12/347,789

(22) Filed: Dec. 31, 2008

(65) Prior Publication Data

US 2009/0175046 A1 Jul. 9, 2009

Related U.S. Application Data

(60) Provisional application No. 61/019,567, filed on Jan. 7, 2008.

(51) Int. Cl.
*F21S 8/00* (2006.01)
*H01R 33/00* (2006.01)

(52) U.S. Cl. ..... 362/431; 362/153.1; 362/652

(58) Field of Classification Search ..... 362/431, 362/652, 653, 657, 658, 659, 152, 153, 153.1; 439/577

See application file for complete search history.

(56) References Cited

U.S. PATENT DOCUMENTS

| | | | | |
|---|---|---|---|---|
| 3,026,496 | A * | 3/1962 | Gluck | 439/683 |
| 3,805,055 | A * | 4/1974 | Cassey | 362/358 |
| 5,116,266 | A * | 5/1992 | Seymour et al. | 439/851 |
| 5,483,432 | A * | 1/1996 | Wang | 362/431 |
| 5,504,397 | A * | 4/1996 | Chien | 315/185 S |
| 5,562,341 | A * | 10/1996 | Strauss | 362/659 |
| 6,053,620 | A * | 4/2000 | Won | 362/96 |
| 6,224,238 | B1 * | 5/2001 | Chen | 362/654 |
| 6,461,018 | B1 * | 10/2002 | Chanslor | 362/249.16 |
| 6,561,681 | B1 * | 5/2003 | Huang | 362/311.01 |
| 6,802,630 | B2 * | 10/2004 | Doppelt | 362/414 |
| 6,966,680 | B2 * | 11/2005 | Kratz | 362/431 |
| 7,137,721 | B1 | 11/2006 | Rao et al. | 362/371 |
| 2007/0091598 | A1 | 4/2007 | Chen et al. | 362/231 |
| 2009/0122564 | A1 * | 5/2009 | Beadle | 362/431 |

* cited by examiner

*Primary Examiner* — Jong-Suk (James) Lee
*Assistant Examiner* — David R Crowe
(74) *Attorney, Agent, or Firm* — Intellectual Property Advisors LLC; Damian G. Wasserbauer

(57) ABSTRACT

A lighting assembly and apparatus having a light fixture mounted using a tube and stake assembly; the tube is configured with a male receptacle formed of a pronged plug positioned vertically with the upper end flush with the earth; and the stake for insertion into the earth, the stake is configured with a female receptacle containing electrical contacts adapted to receive the pronged plug of the male receptacle. The female receptacle is adapted to have an open end so as to clear debris to the bottom of said stake. The light assembly and apparatus can be constructed from low cost, low voltage outdoor lights so as to provide ground level illumination of pathways, steps, and landscaping.

6 Claims, 2 Drawing Sheets

OUTDOOR LIGHT APPARATUS AND ASSEMBLY

CROSS-REFERENCE TO RELATED APPLICATION

The present invention claims priority based on provisional patent application Ser. No. 61/019,567, entitled "OUTDOOR LIGHT APPARATUS AND ASSEMBLY", by James G. Richard, filed on Jan. 7, 2008.

FIELD OF THE INVENTION

The present invention is directed to a light apparatus and specifically to a low voltage electric light assembly configured with a receptacle removable at ground level that automatically clears the contact channel.

BACKGROUND OF THE INVENTION

Known fixed light assemblies are useful for lighting outdoor areas such as a walkway leading up to the front door of a residence, to accent the border of a patio or outdoor space, or to decorate a yard or a garden. Fixed light assemblies utilize conventional line voltage, which 120 v AC electrical energy commonly found in most U.S. residences. Fixed outdoor lighting line voltage assemblies are relatively permanent as such assemblies are built into walls, stairs or posts where varying inclinations of the light source produces directional or aesthetic effects. Such fixed light assemblies are expensive to manufacture as they require a weatherproofed construction for the outdoor application such as additional insulation, gaskets or other adaptations in order to operate in various weather conditions. Fixed light assemblies also have the additional cost associated with installation by the homeowner or professionals to local electrical codes.

Other outdoor line, light assemblies can be configured as portable, which are useful in applications requiring changing various aspects such as the location and/or the inclination of illumination. One known assembly is the popular pivoting light assembly such as a portable, flood lamp unit. The flood lamp unit can be manufactured connect to a line voltage adapted to a surface or ground mounted brackets so as to be relocated or to direct the illumination at select inclinations such as, for example, as is shown in U.S. Pat. No. 7,137,721 B1. However such flood lamps also require a require a weatherproofed construction such as additional housing and power cord gaskets for sealing the lamp and power cord, respectively, and spaced sealing rings thereby providing a sealed cartridge for the electrical socket, which all increase the manufacturing expense.

Other systems can be characterized as lower voltage, whereby an AC-to-DC transformer reduces the voltage from 120-v-AC house current to a much lower level, such as 11 volts, 12 volts, or 16 volts DC. The reduced voltage AC provides power to a series of low-voltage incandescent lamps connected one to another by electrical wiring. Some may include timers. U.S. Patent Application Publication No. US2007/0091598 A1 illustrates a Low-voltage LED garden light.

Other assemblies may be self-contained units employing a stored power supply such as batteries and/or made rechargeable by solar power. Each low voltage assembly is attached to a stake that the homeowner simply pushes a stake at the bottom into the ground, covers over the wire between the fixtures with some dirt, connects the transformer to house current, and sets the timer- and the system is operational.

While low-voltage lighting has become popular, it is not without its problems including the lamps provided in low-voltage lighting fail frequently, and must be replaced, because outdoor applications have severe operating conditions such as, for example, moisture in the form of rain and snow can enter the lamp housing causing electrical and potential safety problems. Other disadvantages include cost, for example, the cost of prior-art low-voltage lighting is above what many consumers are willing to pay for such lighting. Accordingly, there is a need in the art for a low-cost, low-voltage lighting system that will provide greater reliability in outdoor applications.

Current systems have other disadvantages in outdoor applications as the electric conductors to be connected to low voltage powered ground level lighting. The wiring causes problems and inconvenience when removing and replacing. Non-wired fixtures eliminate this problem but are usually solar powered and inadequate as such solar powered units illuminated light is insufficient, uneven, short lived, and uncontrollable. Accordingly, there is a need in the art for a low-cost, low-voltage lighting system that will provide a user with the advantages of wired ground level lighting and the convenience of non-wired solar lighting.

SUMMARY OF THE INVENTION

In light of the deficiencies of prior lighting methods, a first non-limiting aspect provides: a light apparatus comprised in combination: a light fixture mounted using a tube and stake assembly; the tube is configured with a male receptacle formed of a pronged plug positioned vertically with the upper end flush with the earth; and the stake to insert into the earth, the stake is configured with a female receptacle containing electrical contacts adapted to receive the pronged plug of the male receptacle.

An object of the present invention is to provide a plug is integral with or attached to a low voltage outdoor ground level light fixture.

Another object of the present invention is to provide a combined of receptacle and plug assembly having sufficient support of the light fixture so as to maintain the electrical connection for the light fixture and/or repeated removal and reinsertion thereof.

Another object of the present invention is to provide an arrangement that allows removal and reinsertion of the light fixture into the receptacle so as to allow for at will removal for maintenance of the surrounding environment (lawn cutting, digging, etc.) and/or to safeguard and/or store the fixture apart from the stake during dormant or other periods of non-use (winter, maintenance, etc.).

In light of the deficiencies of prior lighting methods, a first non-limiting aspect provides: a low voltage electric light apparatus configured with a receptacle mounted in the ground, designed to receive a mating plug which will physically support and provide low voltage electric current to a lighting fixture which can be positioned at ground level and adapted for an outdoor environment.

It is an object of the present invention to allow the user to easily remove and replace a low voltage ground level lighting fixture without having to connect or disconnect the wiring. Such a feature is advantageous as fixtures can be removed to allow for grounds maintenance, seasonal storage, and damage prevention during other uses of the area, conversion to new or other style fixture, seasonal use such as holiday lighting or snow removal guides, pre-installation of wiring so style and quantity of fixtures can be later decided by user.

DESCRIPTION OF THE EMBODIMENTS

Figure 1:
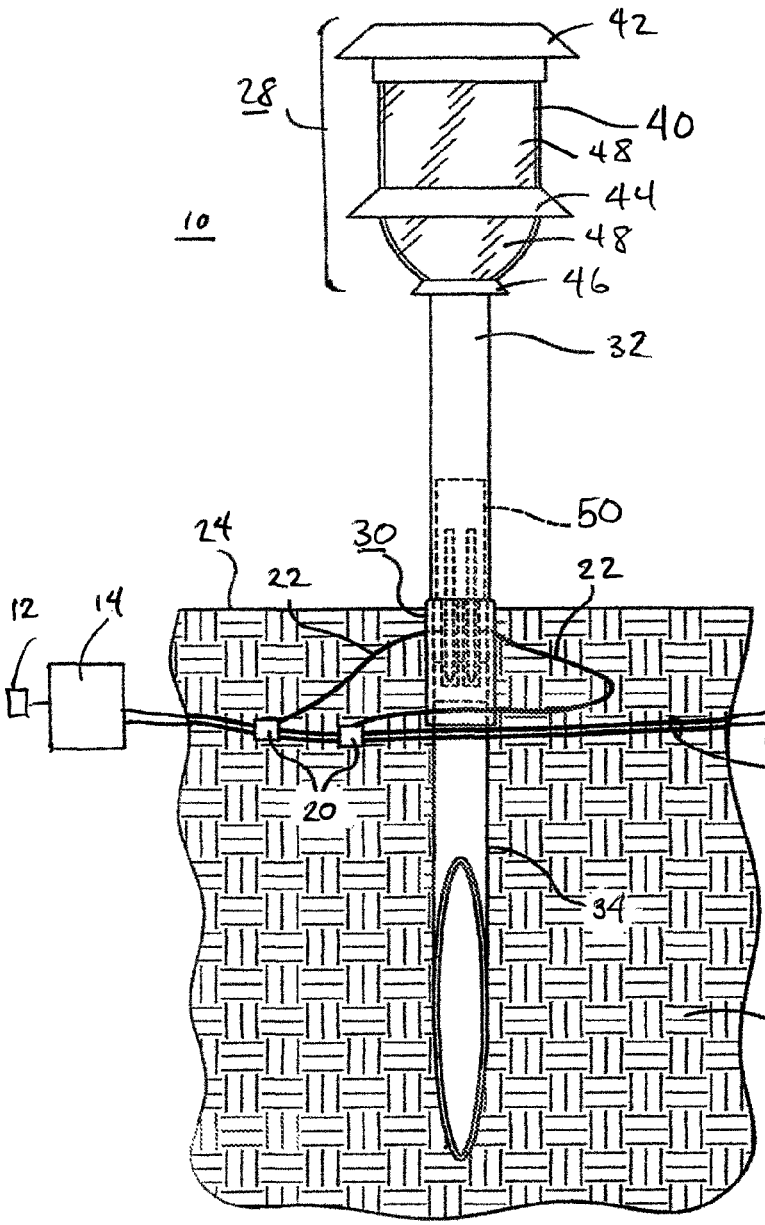
FIG. 1 illustrates an exemplary schematic drawing of the low voltage light assembly and system as a non-limiting aspect of the present invention.

Non-limiting embodiments of the present invention will be described below with reference to the accompanying drawings, wherein like reference numerals represent like elements throughout. While there are many applications for the Low Voltage Light Assembly and Apparatus of the present invention, FIG. 1 illustrates the use of the light apparatus and/or assembly 10 of the present invention in an outdoor application. The present invention is directed to an apparatus of a light assembly utilizing a dual portion support configured with an integral low voltage electric receptacle operable at ground level. In the non-limiting examples described herein, a light for outdoor environments is used to describe aspects of the invention including its electrical plug and receptacle having as its primary use is for ground level outdoor lighting; however, other uses include servicing any electrical device requiring 14 or fewer volts, AC or DC. The light assembly 10 may be useful to illuminate snow removal guides, sign or flag holders, holiday decorations (lighted and/or motorized), landscape tools, pest and insect controls, security devices, etc, as long as the receptacle and plug, wiring and power supply are adequately sized for the required current and the voltage is 14 volts or less. However, it should be understood that the techniques described herein are equally applicable to other types of light assemblies.

While the following explanation addresses specific factors, it is important to understand that a variety of other factors may also be useful to consider when constructing an outdoor light fixture. For example, useful factors may include, but are not limited to: the number of fixtures that will be strung on the low voltage feed wires; a wattage of the light source for the light fixture to be lit whether the fixture is an incandescent, Light Emitting Diodes (LED), fluorescent or halogen bulb source; the desired illumination effects; and the intensity of the illumination and/or quality of the illumination desired.

Referring to FIG. 1, exemplary aspects of the low voltage, light apparatus 10 according to the present invention will now be described. In this non-limiting example, the light apparatus 10 is connected to a source of electrical power or line voltage 12 that can be 120 VAC as is a conventional residential house line voltage in the United States. The current of the line voltage is a higher level than desired to power the light apparatus 10 for safety, power consumption and other outdoor application factors. Reduction of the line voltage or current of the 120 VAC is accomplished by a transformer 14 or other step-down device to the source of electrical power 12. However, other line voltages can be used initially and stepped down by a transformer, such as is conventional in countries other than the United States, as these are also within the scope of the present invention.

According to a preferred embodiment of the present invention, the light apparatus 10 uses low voltage AC power of around 14 VAC, which is supplied by a supply wire 16 to a plurality of light apparatus 18. In the preferred embodiment the low voltage AC is sought not to exceed 14 VAC. The supply wire 16 is of sufficient size, properties, and insulation for outdoor weather conditions and application. The supply wire 16 is placed below the grade or surface 24 of the earth 26 and attached by a tap connection or other connector 20 to light apparatus supply wires 22. The tap connection 20 of each light apparatus 10, which is expanded in number (1, 2, . . . , n, n+1, . . . ) as desired, is buried alongside each light apparatus 10.

For any desired number of fixtures, the transformer selected to provide adequate desired low voltage direct current and/or a satisfactory level of power. Those of ordinary skill in the art will understand that the use of such low-wattage transformers will produce sufficient power utilized by the total recommended number of the plurality of light apparatus 18 in each system, which is also dependent on the illumination source including low-wattage incandescent lamps, LED bulbs, fluorescent, compact halogen, and the like. Thus, the transformer and recommended number of plurality of light apparatus 18 in each system can change based on the requirements of the assembly components.

Referring to FIG. 1, the low voltage, light apparatus 10 further includes a light fixture assembly 28, a support 30 that is configured to be constructed in portions: an upper portion 32 and lower portion 34. The support 30 is constructed from materials sufficient to support the light fixture assembly 28 and adapted to outdoor environmental factors such as water, snow, wind, dirt and the like. The support 30 can be made from a PVC material or low-conductive metal such as aluminum, and/or a combination thereof. In a non-limiting example, the upper portion 32 can be made tubular of a cylindrical shape sufficient to house the electronics and support the light fixture assembly 28; however, other shapes, lengths and sizes can be used as these are also within the scope of the present invention. In a non-limiting example, the upper portion 32 can be made tubular of a cylindrical shape sufficient to house the electronics and support the light fixture assembly 28. However, other shapes, lengths and sizes can be used as these are also within the scope of the present invention. In yet another non-limiting example, the lower portion 34 can be made a tubular, cylindrical shape sufficient to enclose electrical components sufficient to connect to wires 22 and the source of electricity 12. The lower portion 34 can further be made separable in two parts: a cap 34*a* and a stake 34*b*. The cap 34*a* houses electrical components sufficient to connect to wires 22 and the source of electricity 12 and is made open at the bottom to interface with the stake 34*b*. According to an important feature of the present invention, the open bottom of cap 34*a* allow for debris of dirt, water and other contaminants to fall into the stake 34*b* lower portion so as to maintain clear, clean contacts and/or electrical connections. Moreover, this construction simplifies the installation of the light assembly 10, by allowing initially a plurality of caps 34*a* to be attached by taps 20 to the wire 20 as the layout of the desired path for the outdoor lighting is chosen. The cap 34*a* and stake 34*b* can be made cylindrical, preferably having the inner diameter of the cap 34*a* being larger than the outer diameter of the stake 34*b* so as to create an overlapping, friction fit and attachment. The cap 34*a* and stake 34*b* can be made from PVC material or low-conductive metal such as aluminum, and/or a combination thereof. The stake 34*b* can have an earth penetrating end cut acutely to allow for such penetration. The stake 34*b* also may have a protruding upward pointing barb (not shown) to retain the stake 34*b* in the earth 26 so as to allow withdrawing the plug 58, whereby the lower portion 34 and cap 34*a* remains in place. However, other shapes, lengths and sizes can be used as these are also within the scope of the present invention.

Referring again to FIG. 1, the light fixture assembly 28 includes a bulb 36, socket 38, wires 40 (each shown in FIG. 2A) for connecting to the source of electrical power 12 as supplied by supply wires 22 to the light apparatus 10. The bulb 36 and socket 38 of the light assembly 28 are enclosed in an enclosure 40, which can be an attractive, singular construction or multiple component construction as desired. According to an embodiment of the present invention, the enclosure 40 utilizes multiple components of a cap 42, mid-body 44 and base 46, each having an integral flange sufficient to draw water away from the electrical components of the assembly 10. The cap 42, mid-body 44 and base 46 can be manufactured or otherwise formed from metal, plastic, wood or other materials as desired such as, for example, stamped from aluminum or injection molded plastics. Additionally, the enclosure 40 uses a body portion 48 made clear so as to allow light generated by the bulb 36 to illuminate adjacent surfaces 24 of the earth 26. The body portion 48 can be constructed of plastic, glass, crystal, paper or other materials that allow translucence, transparence or partially thereof as desired.

Figure 1A:
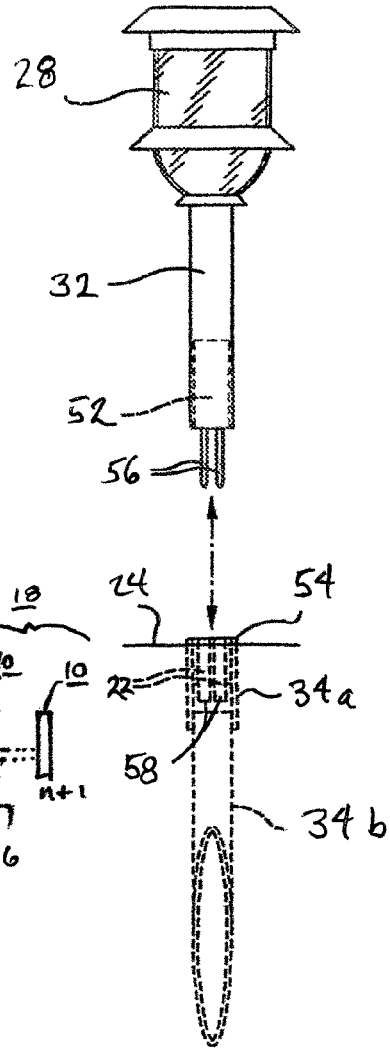
FIG. 1A provides an exploded schematic view of the connection halves of the light assembly of FIG. 1 as a non-limiting aspect of the present invention.

According to a preferred embodiment of the present invention, the support 30 is constructed having a low voltage, receptacle 50 integral to the upper portion 32 and the lower portion 34. In a non-limiting example, as is illustrated in FIGS. 1 and 1A, the receptacle 50 advantageously can be formed to house a male portion 52 in the upper portion 32, and a female portion 54 in the lower portion 34. The male portion 52 includes prong(s) 56 configured to interface with socket 58 disposed in the female portion 54. As is known in the art, the prong 56 and socket 58 form an electrical connection and can be constructed of metal. In operation, the prongs 56 are metal that slidably connect to a tab or other metal connection disposed in the socket to interface and form an electrical connection. As described above, the slidable connection of the socket 58 is made open, as well as the connection between the lower potion 34*a* and the stake 34*b*, so that debris fall through to the open area of the stake and maintain clean contact. The prongs 56 are constructed to provide substantial, physical support of the fixture assembly 28 (and upper portion 32). Alternatively, the male portion 52 can be positioned in the lower portion 34, and a female portion 54 in the upper portion 32, such that the prongs 56 do not protrude above the surface 24 of the earth 26 so to expose them destruction, bending or other harm.

Referring to FIG. 1A, according to a non-limiting example of a preferred embodiment of the present invention, the light assembly 10 is made detachable so as to be removable from the earth 26 for outdoor applications (such as mowing), maintenance, or to put away for the winter. In operation, the lower portion 34 is attached by taps 20 to supply wires 22 and buried to the surface 24. The light fixture assembly 28 and upper portion 32 are inserted into the now buried lower portion 34 by aligning the prongs 56 with the socket 58. The upper portion 32 and prongs 56 physically support and provide a low voltage electrical current to the ground level outdoor lighting fixture 28 so as to energize electrically the bulb 36 to provide illumination. The insertion movement forms the connection as well as clears any debris accumulated or introduced to the lower portion 34, for example, through the opened at the bottom cap 34*a* allowing for drainage of water, dirt and debris to the hollow of stake 34*b* which has sufficient extra space to allow accumulation. In a similar, opposite movement, the light fixture assembly 28 and upper portion 32 can be removed from the lower portion 34. Accordingly, the light apparatus 10 advantageously allows the user to easily remove and replace a low voltage, ground-level outdoor lighting fixture 28 without having to connect or disconnect the wiring. The fixture 28 allows for removal for maintenance, seasonal storage, replacement, damage, upgrading, decorative changes and the like as well as overcoming disadvantages of the prior art including that wired fixtures are set at fixed distances, have inconveniences when removing or replacing fixtures, and overcomes portable, non-wired solar powered fixtures that suffer from inadequate, uneven and/or short illumination periods.

Figure 2A:
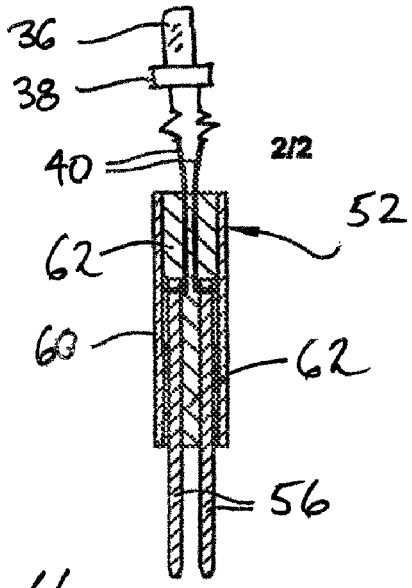
FIG. 2A illustrates an exemplary, exploded cross-sectional view of the plug for the connector portion of the light assembly according to a non-limiting aspect of the present invention.
Figure 2B:
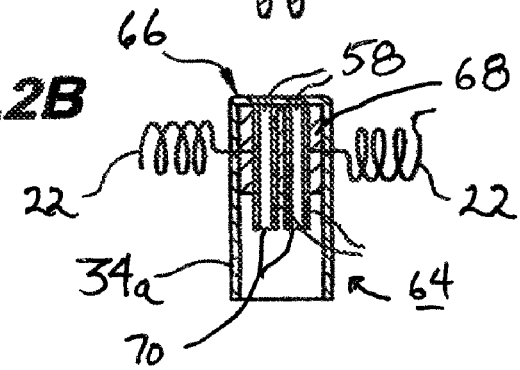
FIG. 2B illustrates an exemplary, exploded cross-sectional view of the receptacle for the connector portion of the light assembly according to a non-limiting aspect of the present invention.
Figure 2C:
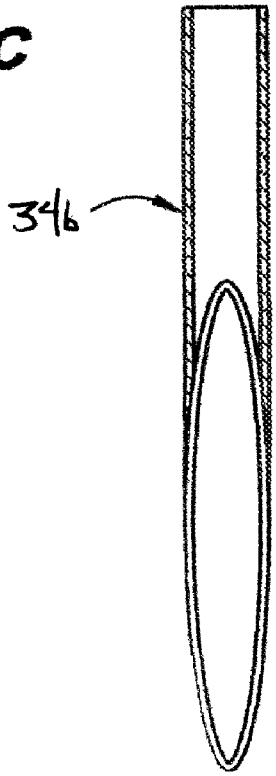
FIG. 2C illustrates an exemplary, exploded cross-sectional view of the mounting stake for the connector portion of the light assembly according to a non-limiting aspect of the present invention.

The construction and operation of the receptacles of light apparatus and assembly 10 of the present invention is best understood by reference to FIGS. 2A, 2B and 2C, and FIG. 3. According to a non-limiting example of a preferred embodiment of the present invention, the receptacle 50 is made of corrosion proof materials encased in a non-conductive structural plastic. As shown in FIG. 2A, the male portion of receptacle 50 can be configured as a plug 60 surrounding prongs 56 attached to wires 40 with insulation 62 so as to fix the position of prongs 56 in the insulation and provide a secure, electrical connection to the socket 38 and bulb 36. Similarly, as shown in FIG. 2B, the female portion of receptacle 50 can be configured as a plug 64 having a cap 66 supporting the female portions 58 attached to supply wires 22 with insulation 68 to provide a secure, electrical connection to the source of electricity 12. The cap 66 and insulation 68 can slidably be inserted into the lower portion 34*a* or formed integral therewith. The lower end 70 of each female portion 58 is open so as to allow advantageously clearing debris to the hollow of the stake 34*a* of FIG. 2C and to provide advantageously a clean, removable connection to the fixture assembly 28 as is described herein.

Figure 3:
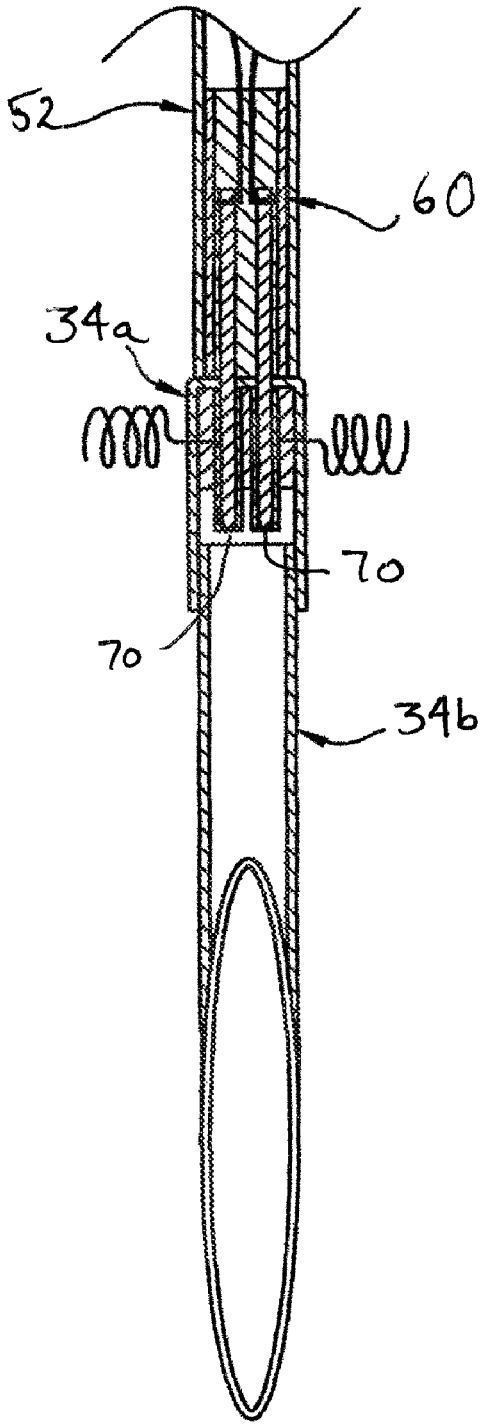
FIG. 3 illustrates an additional exemplary cross-sectional view connecting portions of FIGS. 2A, 2B and 2C for the connector of the light assembly according to a non-limiting aspect of the present invention.

As is illustrated in FIG. 3, when combined the prongs 52 disposed in the upper portion 52 are fully inserted into the female portions 58 thereby electrically connecting the source of electricity 12 attached to supply wires 22 to the wires 40 attached to the socket 38 and bulb 36. The plug 60 surrounding prongs 56 with insulation 62 are sufficiently formed to support the fixture 28. Similarly, the cap 66 supporting the female portions 58 by with insulation 68 the insulation 68 are sufficiently formed to interface with the prongs 58 to support the fixture 28. The lower end 70 of each female portion 58, and the portion 34*a* is open so as to allow advantageously clearing debris to the hollow of the stake 34*b* and to provide advantageously a clean, removable connection to the fixture assembly 28 as is described herein.

Additional advantages and modifications will readily occur to those skilled in the art. For example, the assembly may be made of plastic or suitable structural material. The receptacle may have ports of a round shape, square, or blade shape, all metal or plastic with molded in contacts. The plug may have metallic pins the shape of the ports or plastic with molded in contacts. The plug side may be molded of formed into the support of the fixture by the manufacturer or the plug may have a universal mount to fit any support either by clamping, adhesive, or mechanical fasteners. The assembly may even have one large pin of plastic with molded in contacts. However, the any modifications should maintain the feature that the bottom of the receptacle is open so any water may drain thru and any debris will be ejected downward into the hollow stake when the plug is inserted. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A low voltage light assembly comprising: a light fixture; a tube configured to support said light fixture, said tube having a male portion of an electrical connector formed at a lower end of said tube opposite said light fixture, said male portion having a pronged end, and being configured to connect a source of power to said light fixture; a stake, said stake having a female portion of said electrical connector at an upper end thereof, said female portion having an open bottom end, said stake configured to be inserted into the earth, said stake adapted to hold an open top end of said female portion of said electrical connector at an upper end of said stake adjacent to the earth, wherein said female portion is advantageously adapted to receive said pronged end of said male portion, and allow for the clearing of any debris from the female portion to an open area of said stake and to connect electrical contacts of said light fixture to said source of power.

2. The low voltage light assembly according to claim 1, wherein said light fixture can be a light formed from the group of incandescent, Light Emitting Diodes (LED), fluorescent or halogen bulbs.

3. The low voltage light assembly according to claim 1, wherein said tube is configured with said pronged end positioned vertically with the upper end of said stake flush relative to the earth.

4. The low voltage light assembly according to claim 3, wherein said pronged end further comprising a pronged plug.

5. The low voltage light assembly according to claim 1, wherein said tube and said stake are configured from elongated tubes of sufficient strength adapted (i) to support said fixture a predetermined distance above the earth or (ii) to provide for removal of the male portion of said electrical connector from the female portion.

6. A removable, low voltage connector with a light fixture, comprising: a light fixture; an elongated tube supporting the light fixture; and an electrical connector; a male portion of said electrical connector is disposed in an upper portion of said elongated tube at an end opposite the light fixture, said male portion having at least one prong sufficient to support light fixture and connect the light fixture to a source of power; and a female portion of said electrical connector configured as a socket adapted to interface with said at least one prong, said female portion disposed in a lower portion of said elongated tube, said lower portion adapted as a stake for insertion into the earth, with said lower portion being separate from said upper portion having the light fixture, whereby said female portion is configured with an open bottom end in said lower portion of said elongated tube, thereby being adapted to clear debris so that debris will fall through to an open area of the stake and maintain clean contact.

* * * * *